United States Patent [19]

Kuryn

[11] 4,327,515

[45] May 4, 1982

[54] STARTER FOR MUZZLE LOADING FIREARM

[76] Inventor: Walter Kuryn, 262 Britannia St., Meriden, Conn. 06450

[21] Appl. No.: 155,296

[22] Filed: Jun. 2, 1980

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 11,174 | 6/1854 | Peavey | 42/90 |
| 163,404 | 5/1875 | Phillips | 42/90 |
| 3,747,252 | 7/1973 | Walker | 42/90 |
| 4,050,175 | 9/1977 | Mulinix | 42/90 |
| 4,094,098 | 6/1978 | Gourley | 42/90 |
| 4,112,606 | 9/1978 | Griffin | 42/90 |
| 4,152,858 | 5/1979 | Dobbs | 42/90 |
| 4,229,897 | 10/1980 | Snowden | 42/90 |

*Primary Examiner*—Charles T. Jordan

*Attorney, Agent, or Firm*—DeLio and Libert

[57] ABSTRACT

A starter for use in the loading of projectiles in a muzzle loading firearm. Means for aligning the starter with the bore of the firearm is provided by a rod which is received in the ramrod guides mounted on the barrel of the firearm. The rod also serves as a ramrod.

18 Claims, 5 Drawing Figures

STARTER FOR MUZZLE LOADING FIREARM

This invention relates to muzzle loading firearms; more particularly, this invention relates to a device for loading a projectile in a muzzle loading firearm of a type having a ramrod guide or a thimble.

BACKGROUND OF THE INVENTION

In order to more fully appreciate the present invention, it is instructive to examine the background related to the discharging of muzzle loading firearms. The discharging of muzzle loading firearms is frequently enjoyed as a sport in wilderness and semi-wilderness environments which require transporting the firearm, ammunition and accessories substantial distances on foot. The sport is frequently enjoyed in colder climates or at times in the year when the weather is relatively cold. An important feature of the sport associated with muzzle loading firearms is the manual skill and expertise that is required of the sportsman. In addition, the sport of muzzle loading firearms in its purest practice demands a certain adherence to individual craftsmanship, simpler technologies and historical perspective.

There are, therefore, a substantial number of general design parameters which are desirable in relation to starters or any tools used with muzzle loading firearms. The starters should be lightweight, easily portable, easy to use, and of relatively simple mechanical structure. The starter should be a tool which can be employed to enhance the skill, accuracy, efficiency and enjoyment of the sportsman but not at the expense of elaborate technology.

The procedure for loading and preparing a muzzle loading firearm for discharge normally starts with the introduction of black gun powder or other suitable propellant into the bore of the firearm. A projectile is placed on a patch which has been lubricated by either saliva or other suitable lubricant, and both projectile and patch are positioned at the muzzle opening of the firearm. The projectile and patch are then forced into the muzzle.

It should be noted that some projectiles may not require the use of a patch. In the latter case, the procedure for loading the muzzle loading firearm is substantially identical to the procedure used when a patch is required excepting of course the procedures relating to a patch.

Optimum discharge performance is obtained when the projectile and patch form a relatively tight fit when inserted into the muzzle. The requisite concentration of force for inserting the projectile and patch into the first few inches of the barrel is supplied by means of the starter. It should be noted that some amount of manual coordination is normally necessary to correctly position the projectile and patch while simultaneously employing the starter to initially insert the projectile and patch into the muzzle.

After the projectile and patch have been started into the muzzle of the firearm, the projectile and patch are moved the remaining distance down the length of the bore of the firearm and forced to seat against the powder by means of a ramrod.

Because accuracy with respect to the discharge of muzzle loading firearms is a function of uniform loading procedure, and efficiency, i.e., rapidity of successive discharges of the firearm, is a function of ease of loading, of critical concern is the means for positioning or aligning the starter with the projectile and the muzzle. The aligning process may be viewed as being composed of several components: ease of obtaining alignment, accuracy and uniformity of alignment, and maintenance of alignment during the process of starting the projectile.

Some prior art starters provide mechanical means for aligning the starter with the projectile and the muzzle of the firearm. Other prior art starters provide no means for aligning the starter other than entirely manual alignment means. Prior art loading devices generally require the use of both hands of the loader in order to position the projectile and use the starter to load the projectile into the muzzle of the firearm.

This invention is a significant advancement over the prior art devices in that the loader can more easily load a projectile into a muzzle loading firearm, in most instances with essentially one hand. Moreover, the ease and accuracy of alignment is not significantly affected when difficulty of hand and finger coordination is experienced, for example as a result of cold weater or other adverse conditions.

Unlike previous prior art starters, preferred embodiments of the present invention eliminate the need for a separate ramrod to complete the loading procedure.

SUMMARY OF THE INVENTION

The new and improved starter comprises in one form a guide means which receives a plunger. The plunger is adapted to extend through to the bottom of the guide means and to seat against a projectile. A rod parallel to the plunger extends from the bottom of the guide means for securing the starter in proper alignment. The rod is secured to the firearm by the ramrod guides or thimbles. The rod may also serve as a ramrod. Alternate embodiments of the starter employ a means for adjusting the distance between the plunger and the rod so that the starter upon suitable adjustment may be used in loading a multiplicity of makes and models of muzzle loading firearms.

An object of this invention is to provide a new and improved starter for loading a muzzle loading firearm in which means for aligning the starter with the muzzle are provided by securing the starter to the ramrod guide or thimbles of the muzzle loading firearm.

An object of this invention is to provide a new and improved starter for loading a muzzle loading firearm which can be effectively operated, even with one hand.

A further object of this invention is to provide a new and improved starter for loading a muzzle loading firearm which can also be used as a ramrod to complete the loading procedure.

A further object of this invention is to provide a new and improved starter for loading a muzzle loading firearm which facilitates the uniform loading of projectiles into the firearm.

A still further object of this invention is to provide a new and improved starter for loading muzzle loading firearms which is easily adjustable for use in connection with a multiplicity of firearm makes and models.

The invention accordingly comprises an article of manufacture possessing the features, properties and the relation of elements and components which will be exemplified in the construction hereinafter set forth.

BRIEF DESCRIPTION OF THE DRAWINGS

A practical embodiment of the invention is shown in the accompanying drawing wherein.

DETAILED DESCRIPTION

Figure 1:
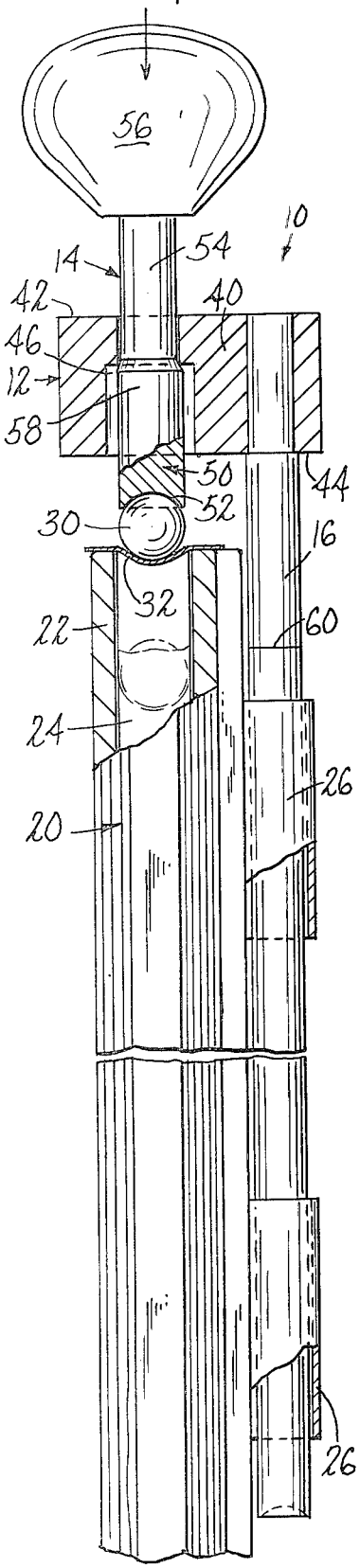
FIG. 1 is a vertical sectional view of the starter, also showing a projectile and a muzzle loading firearm illustrating the initial loading procedure, parts of the firearm being broken away to illustrate a subsequent position of the firearm projectile.

With reference to FIG. 1, the starter generally shown as 10 comprises a guide means 12, a plunger means 14, and a rod 16. The barrel of a muzzle loading firearm, shown generally as 20, comprises muzzle 22, bore 24, and ramrod guides 26. Rod 16 is received in ramrod guides 26. Prior to the initial loading of a projectile, plunger means 14 is positioned to seat above projectile 30.

The guide means 12 comprises a substantially rectangulr base 40 having a top surface 42 and a bottom surface 44. A centrally located opening 46 extends from the top surface 42 to the bottom surface 44. The opening is preferably of a step-concentric cylindrical shape as shown in FIG. 1.

A plunger means 14 is slidably received in the opening 46 of the guide means. The plunger means 14 comprises a rod-like plunger element 50 having a plunger bottom 52 and plunger top 54. The diameter of plunger bottom 52 is less than the diameter of bore 24. Plunger bottom 52 is further adapted to seat against a projectile 30 which may be in the form of a ball or a maxi-ball. The surface of the plunger bottom may therefore be concave. The plunger top 54 is adapted to receive and/or transfer compression. A knob 56 mounted on the plunger top is suitable for both receiving compression and for rotating the plunger into an aligned position with the projectile and the bore.

The dimension of the opening 46 and the plunger 50 are substantially commensurate so as to provide for a vertical sliding movement of the plunger relative to the base 40 while minimizing the horizontal or sideways movement of the plunger relative to the base. A stop 58 can be merely a portion of the plunger which is of enlarged diameter relative to the diameter at the bottom of the base of opening 46. The plunger is further secured by means of the knob 56 which has a diameter larger than the diameter of opening 46 at the top of the base.

Rod 16 extending from the bottom of the base is parallel to the plunger 50. Rod 16 is adapted to be slidably received in the thimbles or ramrod guides 26 mounted on the barrel 20 as illustrated in FIG. 1. The rod may also serve as a ramrod and is thus of a uniform length and diameter, which is roughly commensurate with the bore diameter and the barrel length of the given firearm.

It can be seen from FIG. 1 that upon securing the rod in the ramrod guides, the starter may be suitably rotated so that the plunger end bottom 52 is aligned with the bore 24 of the barrel 20.

In operation, the starter is secured to the firearm by inserting the rod 16 into the ramrod guides 26 mounted on the barrel from a direction at the terminal end of the muzzle. The firearm is positioned in a substantially upright position. A precise quantity of gun powder is poured down the barrel. A patch 32 is placed over the end of the muzzle as shown in FIG. 1. A projectile 30 which may be in the form of a ball is positioned on top of the patch. After suitable rotation, the plunger bottom is seated over the projectile to align the plunger with the bore. The projectile and patch are inserted into the bore by means of a downward force applied at the knob. Optimum accuracy and range results are generally obtained if the projectile and patch upon entry into the muzzle are in substantially tight-fitting engagement. The starter aids in transmitting and concentrating the requisite force.

After the projectile and patch have substantially entered the bore, a more substantial compressive force is applied at the knob which forces the projectile a sufficient distance down the bore so that a ramrod may be employed to force the projectile the remaining distance into the bore and seat the projectile against the powder. It is usually desirable for the starter to drive the ball approximately two inches into the barrel of a muzzle loading rifle. The latter distance, however, may vary slightly from firearm to firearm. It should be noted that the desirable distance can be uniformly maintained by suitable construction of the plunger so that the maximum movement of the plunger relative to the base will be approximately two inches or the desired starting distance. The engagement of the bottom of the enlarged diameter of knob 56 against the base top 12 insures that optimum maximum distance is obtained provided sufficient compressive force is applied to the knob. Because of essentially uniform alignment, uniform starting force and uniform starting distance for each loading, the starter facilitates more consistent discharge characteristics. Moreover, the projectilecan be positioned, the starter aligned, and proper compressive force applied with one hand.

Figure 2:
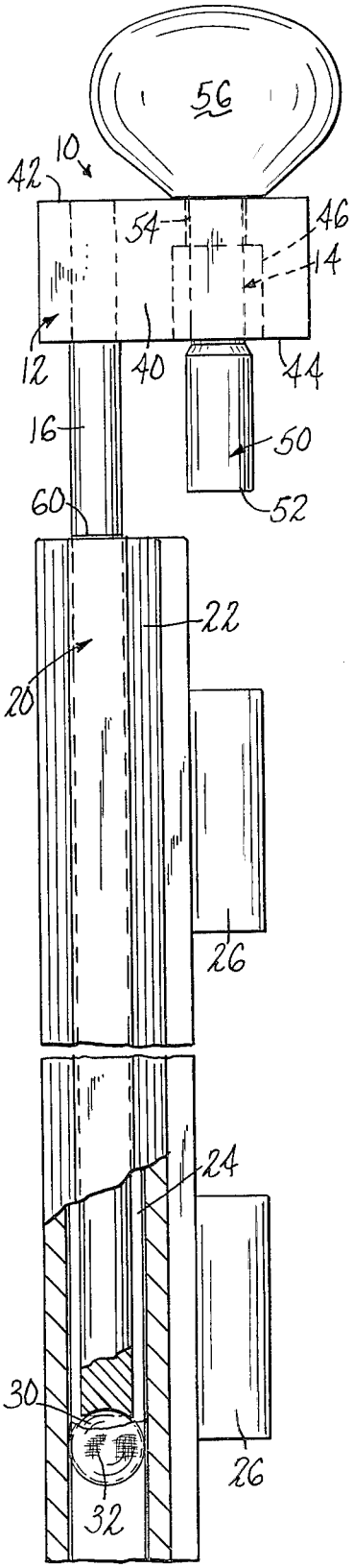
FIG. 2 is a vertical sectional view of the starter and a muzzle loading firearm, partially in section, illustrating the use of the rod as a ramrod.
Figure 3:
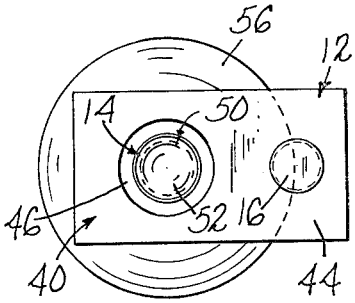
FIG. 3 is a bottom view of the starter.

With reference to FIG. 2, after the projectile is started into the muzzle, the plunger is withdrawn from the bore of the firearm. The rod is withdrawn from the ramrod guides and is then inserted into the muzzle and positioned against the projectile. The rod may then be used as a conventional ramrod to force the projectile down the barrel of the firearm until it contacts the powder charge as shown in FIG. 2. Because correctly seating the ball against the charge is important in obtaining uniform and accurate projectile discharge, mark 60 is preferably placed on the rod to indicate when correct depth of the rod in the barrel is obtained. The rod is removed from the barrel and the firearm has now been accurately and efficiently loaded and is ready for firing.

It is, however, fully with the purview of the invention that a conventional ramrod may be used to complete insertion of the projectile into the barrel, either in conjunctin with or as a substitute for use of the rod portion of the starter.

Figure 4:
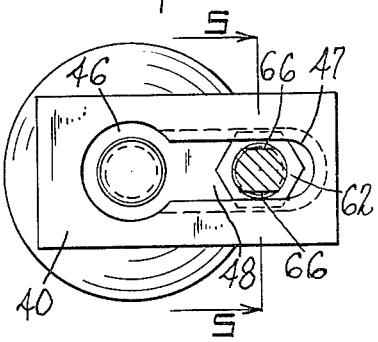
FIG. 4 is a bottom sectional view of an alternate embodiment of the starter.
Figure 5:
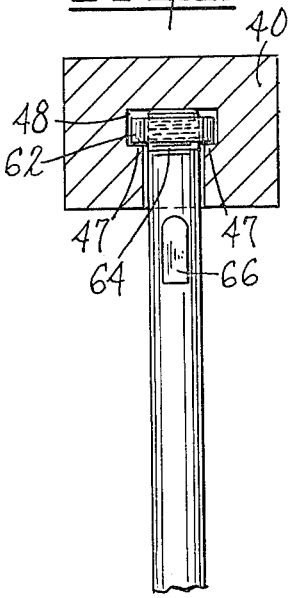
FIG. 5 is a vertical sectional view along the line 5—5 of FIG. 4.

In an alternate embodiment of the new and improved starter, provision is made for adjusting the distance between the rod 16 and plunger 50 so that correct alignment of the starter can be obtained for a wide variety of muzzle loading firearm makes and models. To accomplish the latter, the opening 46 is extended to form a transverse channel 48 opening on the bottom 44 of the base as illustrated in FIG. 4. The channel 48 is further defined by a lip 47.

Rod 16 is provided with threads 64 at one end. Opposing flat surfaces 66 adjacent the threaded end provide a surface for applying a wrench or other tool to turn the rod.

The diameter of the opening at the bottom surface of the base is sufficient so that a lock nut may be accomodated. The lock nut 62 is then slid along the lip 47 until the correct distance between the plunger, which is centrally located in the opening, and the nut is obtained. The rod 16 is secured firmly in place by means of turning the rod, thus threading the lock nut and forcing the end of the rod against the upper surface of the channel. Suitable adjustment can be made by merely loosening the rod and moving it along the lip and tightening the rod when the correct position has been obtained.

It should be noted that the starter can be adaptable for a multiplicity of firearm calibers by removing plunger 50 and replacing it with a plunger having a plunger bottom 52 of a diameter substantially commensurate with the diameter of bore 24 for a given caliber. A series of interchangeable plungers each having a plunger bottom corresponding to differing caliber dimensions would thus provide a suitable starter for a wide variety of firearm makes, models, and calibers.

The preferred materials used in constructing the starter are brass, plastic, wood or aluminum. Materials such as steel which will cause a spark should be avoided. Lightweight materials are desirable especially when the starter must be carried substantial distances as often happens in hunting and sport shooting.

The starter may be used in connection with muzzle loading pistols as well as muzzle loading rifles and other muzzle loading firearms. Naturally, the starter may also be used with maxi-ball projectiles which may not require a patch.

It will thus be seen that the objects set forth above, among those made apparent from the preceding description are efficiently obtained, and since certain changes may be made in the above construction without departing from the spirit and scope of the invention, it is intended that all matter contained in the above description and shown in the accompanying drawing shall be interpreted as illustrative and not in a limiting sense.

I claim:

1. A starter for loading a projectile in a muzzle loading firearm comprising:

(a) a guide means having a top and bottom;

(b) a plunger means slidably received in said guide means, said plunger means being capable of extending through the bottom of said guide means; and (c) a rod extending from the bottom of said guide means, said rod being parallel to said plunger means.

2. The starter of claim 1 wherein said firearm has at least one ramrod guide and said rod is adapted to be slidably received in at least one of said guides.

3. The starter of claim 1 wherein said plunger means further comprises a plunger having a top and a bottom, said top adapted to receive compression, and said bottom adapted to seat against the projectile.

4. The starter of claim 3 wherein the bottom of said plunger is concave.

5. The starter of claim 3 wherein the top of said plunger comprises a knob.

6. The starter of claim 1 wherein the plunger means is adapted for alignment with the muzzle upon the rod being slidably received in a ramrod guide.

7. The starter of claim 1 wherein the starter further comprises an adjustment means which allows for adjusting the distance between the plunger means and the rod.

8. The starter of claim 1 wherein said plunger means is received in an opening extending from the top to the bottom of the guide means.

9. The starter of claim 1 wherein said plunger means further comprises a stop for securing said plunger means to said guide means.

10. The starter of claim 9 wherein said stop comprises the bottom of said plunger having a greater diameter than the diameter of the opening at the bottom of the guide means.

11. The starter of claim 1 wherein said rod is further adapted to be used as a ramrod for said firearm.

12. In combination, a muzzle loading firearm having a barrel, a bore therethrough, and at least one ramrod guide mounted on said barrel; and a starter comprising:

(a) a guide means having a top and bottom;

(b) a plunger means slidably received in said guide means, said plunger means being capable of extending through the bottom of said guide means; and (c) a rod extending from the bottom of said guide means and slidably received in at least one of said ramrod guides so that said plunger means is adapted for alignment with said bore.

13. The combination of claim 12 wherein said rod is adapted to be used as a ramrod for said firearm.

14. The combination of claim 13 wherein said plunger means comprises a plunger having a bottom, the diameter of said bottom being less than the diameter of said bore.

15. The combination of claim 14 wherein said plunger bottom is adapted to seat against a projectile which is loaded in said firearm.

16. The combination of claim 14 wherein said plunger means further comprises a plunger having a top, said top adapted to receive compression.

17. The combination of claim 15 wherein the maximum distance of movement of said plunger relative to said guide means is commensurate with the distance required to start the loading of a projectile in the barrel of said firearm.

18. The combination of claim 13 wherein said rod further comprises a mark for indicating the correct distance for moving a projectile into said barrel when said rod is used as a ramrod.

* * * * *